US010794207B2

(12) United States Patent
Hough

(10) Patent No.: US 10,794,207 B2
(45) Date of Patent: Oct. 6, 2020

(54) GAS TURBINE ENGINE AIRFOIL COMPONENT PLATFORM SEAL COOLING

(71) Applicant: United Technologies Corporation, Farmington, CT (US)

(72) Inventor: Matthew Andrew Hough, West Hartford, CT (US)

(73) Assignee: RATHEON TECHNOLOGIES CORPORATION, Farmington, CT (US)

( * ) Notice: Subject to any disclaimer, the term of this patent is extended or adjusted under 35 U.S.C. 154(b) by 845 days.

(21) Appl. No.: 15/022,025

(22) PCT Filed: Sep. 11, 2014

(86) PCT No.: PCT/US2014/055193

§ 371 (c)(1),
(2) Date: Mar. 15, 2016

(87) PCT Pub. No.: WO2015/084449

PCT Pub. Date: Jun. 11, 2015

(65) Prior Publication Data

US 2016/0230581 A1 Aug. 11, 2016

Related U.S. Application Data

(60) Provisional application No. 61/879,009, filed on Sep. 17, 2013.

(51) Int. Cl.
*F01D 11/00* (2006.01)
*F01D 5/08* (2006.01)
(Continued)

(52) U.S. Cl.
CPC ..... *F01D 11/006* (2013.01); *F01D 5/081* (2013.01); *F01D 5/187* (2013.01); *F01D 5/225* (2013.01);
(Continued)

(58) Field of Classification Search
CPC ..... F01D 11/006; F01D 5/081; F01D 11/005; F01D 11/008; F01D 5/187; F01D 9/041;
(Continued)

(56) References Cited

U.S. PATENT DOCUMENTS 4,650,394 A * 3/1987 Weidner ..... F01D 11/08 415/115
4,767,260 A 8/1988 Clevenger et al.
(Continued)

FOREIGN PATENT DOCUMENTS

DE 10306915 A1 * 9/2004 ..... F01D 11/005
EP 2551562 1/2013
(Continued)

OTHER PUBLICATIONS

The Extended European Search Report for EP Application No. 14868004.4, dated May 8, 2017.
(Continued)

*Primary Examiner* — Moshe Wilensky
*Assistant Examiner* — Christopher R Legendre
(74) *Attorney, Agent, or Firm* — Carlson, Gaskey & Olds, P.C.

(57) ABSTRACT

A gas turbine engine component array includes first and second components each having a platform. The platforms are arranged adjacent to one another and provide a gap. A seal is arranged circumferentially between the first and second components and in engagement with the platforms to obstruct the gap. A cooling hole is provided in the seal and is in fluid communication with the gap. The cooling hole has an increasing taper toward the gap.

15 Claims, 4 Drawing Sheets

(51) Int. Cl.

| | |
|---|---|
| ***F01D 9/04*** | (2006.01) |
| ***F01D 5/22*** | (2006.01) |
| ***F01D 5/18*** | (2006.01) |
| ***F01D 5/30*** | (2006.01) |
| ***F01D 25/24*** | (2006.01) |

(52) U.S. Cl.
CPC ..... *F01D 5/3007* (2013.01); *F01D 9/041* (2013.01); *F01D 25/246* (2013.01); *F05D 2220/32* (2013.01); *F05D 2240/11* (2013.01); *F05D 2240/55* (2013.01); *F05D 2240/57* (2013.01); *F05D 2240/81* (2013.01); *F05D 2250/323* (2013.01)

(58) Field of Classification Search
CPC ..... F05D 2240/11; F05D 2240/57; F05D 2240/81
See application file for complete search history.

(56) References Cited

U.S. PATENT DOCUMENTS

| | | | | |
|---|---|---|---|---|
| 5,281,097 | A | 1/1994 | Wilson et al. | |
| 5,382,135 | A * | 1/1995 | Green | F01D 5/145 415/115 |
| 5,415,526 | A | 5/1995 | Mercadante et al. | |
| 5,573,375 | A | 11/1996 | Barcza | |
| 5,827,047 | A | 10/1998 | Gonsor et al. | |
| 6,171,058 | B1 | 1/2001 | Stec | |
| 8,382,424 | B1 * | 2/2013 | Liang | F01D 11/006 277/644 |
| 2012/0189424 | A1 | 7/2012 | Propheter-Hinckley et al. | |
| 2013/0028713 | A1 * | 1/2013 | Giri | F16J 15/064 415/135 |
| 2013/0205790 | A1 | 8/2013 | Xu et al. | |
| 2014/0003950 | A1 | 1/2014 | Beattie et al. | |
| 2014/0099189 | A1 * | 4/2014 | Morris | F01D 5/186 415/115 |
| 2016/0003056 | A1 | 1/2016 | Xu | |

FOREIGN PATENT DOCUMENTS

| | | |
|---|---|---|
| GB | 2166805 | 5/1986 |
| JP | 2003035105 | 2/2003 |

OTHER PUBLICATIONS

International Search Report and Written Opinion for PCT/US20141055193 dated Jun. 24, 2015.
International Preliminary Report on Patentability for PCT Application No. PCT/US2014/055193 dated Mar. 31, 2016.

* cited by examiner

GAS TURBINE ENGINE AIRFOIL COMPONENT PLATFORM SEAL COOLING

CROSS-REFERENCE TO RELATED APPLICATIONS

This application claims priority to U.S. Provisional Application No. 61/879,009, which was filed on Sep. 17, 2013 and is incorporated herein by reference.

STATEMENT REGARDING FEDERALLY SPONSORED RESEARCH OR DEVELOPMENT

This invention was made with government support under Contract No. FA8650-09-D-29230021 awarded by the United States Air Force. The Government has certain rights in this invention.

BACKGROUND

This disclosure relates to a gas turbine engine seal used in an airfoil component array. More particularly, the disclosure relates to a cooling hole provided in the seal arranged at an airfoil component platform.

Gas turbine engines typically include a compressor section, a combustor section and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

Both the compressor and turbine sections may include alternating series of rotating blades and stationary vanes that extend into the core flow path of the gas turbine engine. For example, in the turbine section, turbine blades rotate and extract energy from the hot combustion gases that are communicated along the core flow path of the gas turbine engine. The turbine vanes, which generally do not rotate, guide the airflow and prepare it for the next set of blades.

Circumferential seals are used between adjacent airfoil components, such as turbine vanes and blades. The seals are provided at an inner gas flow path to seal between adjacent platforms of the airfoil components. Gaps are typically provided circumferentially between adjacent lateral faces of adjoining platforms to accommodate thermal growth during engine operation. Round holes have been provided in the seal that are in communication with the gap. The holes are normal to the sealing surface of the seal.

SUMMARY

In one exemplary embodiment, a gas turbine engine component array includes first and second components each having a platform. The platforms are arranged adjacent to one another and provide a gap. A seal is arranged circumferentially between the first and second components and in engagement with the platforms to obstruct the gap. A cooling hole is provided in the seal and is in fluid communication with the gap. The cooling hole has an increasing taper toward the gap.

In a further embodiment of the above, the seal includes a gas path flow side that engages the platform. Another side is arranged opposite the gas path flow side and facing a cavity provided between the first and second components. The cooling hole is configured to fluidly connect the cavity to the gap.

In a further embodiment of any of the above, the seal is a damper seal arranged in the pocket.

In a further embodiment of any of the above, the seal extends axially lateral faces of the platform to obstruct the gap.

In a further embodiment of any of the above, a slot is provided in each of the lateral faces. The seal is a feather seal arranged within the slots.

In a further embodiment of any of the above, the lateral faces overlap the cooling hole in a circumferential direction.

In a further embodiment of any of the above, the cooling hole is arranged at an acute angle with respect to the gas path flow side. The cooling hole extends generally in a lengthwise direction of the gap.

In a further embodiment of any of the above, the cooling hole includes a metering portion and a diffuser portion.

In a further embodiment of any of the above, the metering portion has a length L and a diameter D. The metering portion has an L/D ratio of greater than 1.

In a further embodiment of any of the above, the L/D ratio is greater than 3.

In a further embodiment of any of the above, the diffuser portion has a width greater than height. Width is arranged in a circumferential direction.

In a further embodiment of any of the above, the first and second components are blade outer airseals or turbine blades.

In another exemplary embodiment, a gas turbine engine component seal includes a wall that has a gas flow path side and another side opposite the gas flow path side. A cooling hole is provided in the wall and extends in a direction at an acute angle relative to the gas path flow side. The cooling hole has an increasing taper toward the gas path flow side.

In a further embodiment of the above, the cooling hole includes a metering portion and a diffuser portion. The metering portion has a length L and a diameter D. The metering portion includes an L/D ratio of greater than 1.

In a further embodiment of any of the above, the L/D ratio is greater than 3.

In a further embodiment of any of the above, the diffuser portion has a width greater than height. The wall has a length and a circumferential width that is less than the length. The width of the diffuser portion is oriented in generally the same direction as the circumferential width.

In another exemplary embodiment, a method of cooling a gas turbine engine component array includes the steps of providing cooling fluid to a cavity between adjacent components, flowing cooling fluid from the cavity through a cooling hole in a seal provided between the adjacent components, and diffusing the cooling fluid through the cooling hole on a gas path flow side of the seal opposite the cavity to create a cooling film in a gap provided between adjacent platforms of the components.

In a further embodiment of the above, the cooling hole is arranged at an acute angle with respect to the gas path flow side. The cooling hole extends generally in a lengthwise direction of the gap. The cooling hole includes a metering portion and a diffuser portion.

In a further embodiment of any of the above, the metering portion has a length L and a diameter D and an L/D ratio of greater than 1. The diffuser portion has a width greater than height. The width is arranged in a circumferential direction.

In a further embodiment of any of the above, the adjacent components are blade outer airseals or turbine blades.

BRIEF DESCRIPTION OF THE DRAWINGS

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
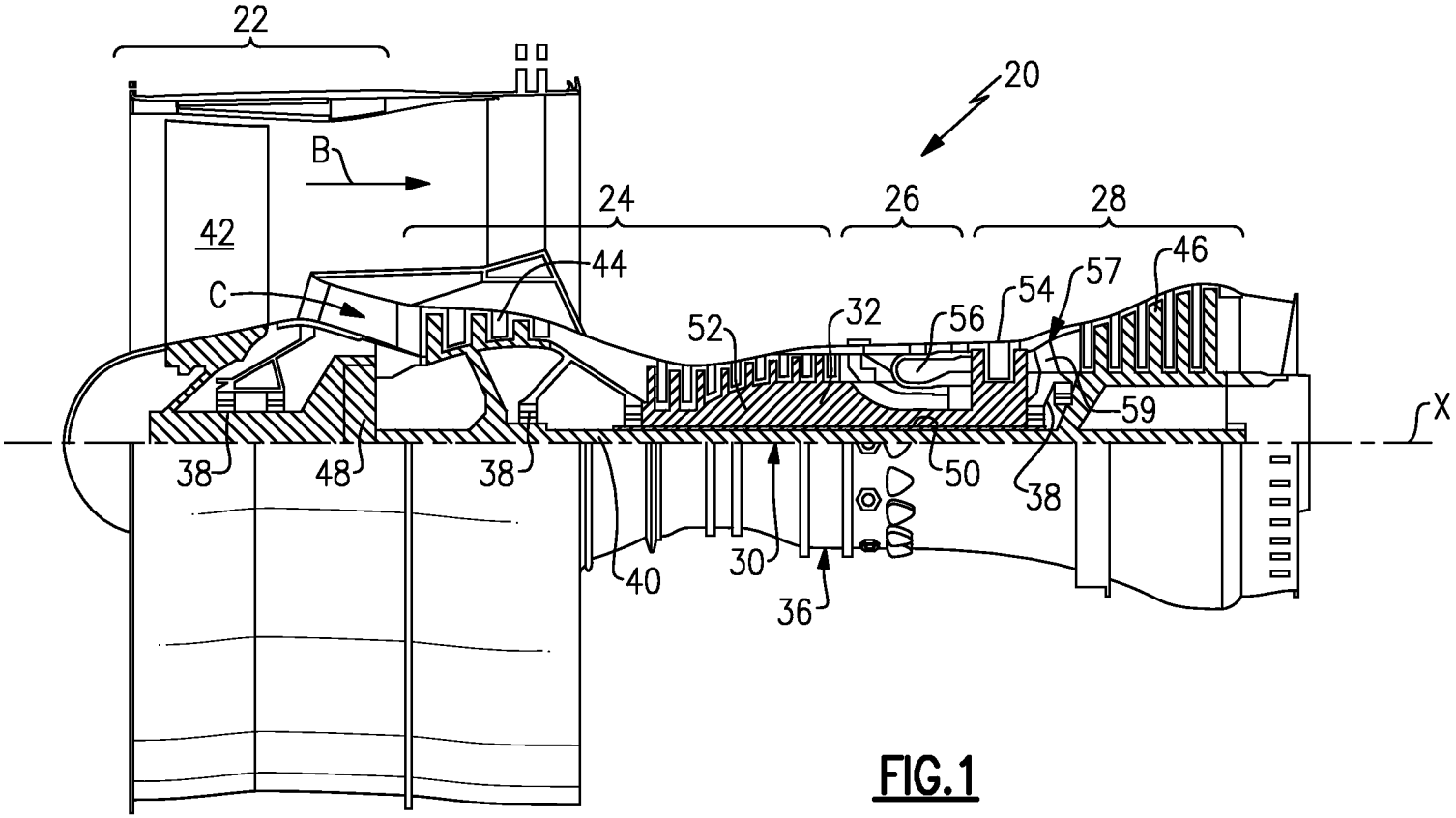
FIG. 1 schematically illustrates a gas turbine engine embodiment.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath B while the compressor section 24 drives air along a core flowpath C (as shown in FIG. 2) for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 supports one or more bearing systems 38 in the turbine section 28. The inner shaft 40 and the outer shaft 50 are concentric and rotate via bearing systems 38 about the engine central longitudinal axis A, which is collinear with their longitudinal axes.

The core airflow C is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The disclosed serpentine cooling passage may be used in various gas turbine engine components. For exemplary purposes, a turbine blade 64 is described. It should be understood that the cooling passage may also be used in vanes, blade outer air seals, and turbine platforms, for example.

Figure 2A:
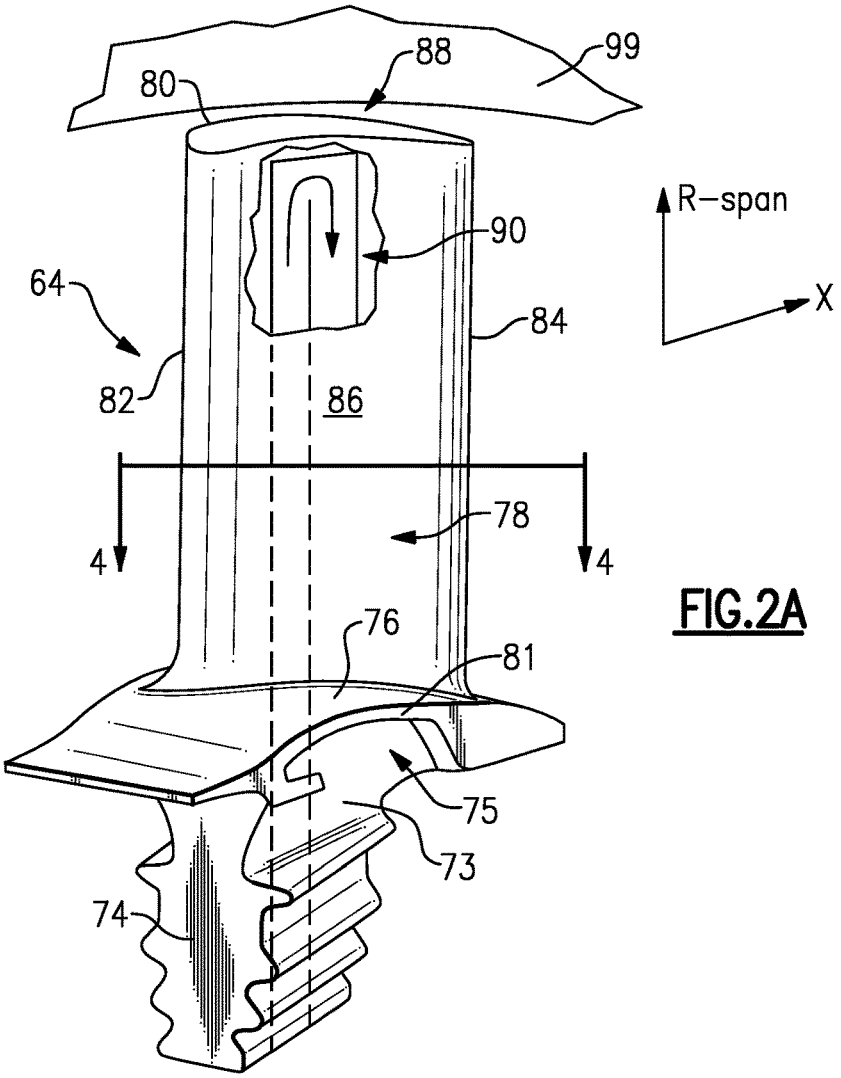
FIG. 2A is a perspective view of the airfoil having the disclosed cooling passage.
Figure 2B:
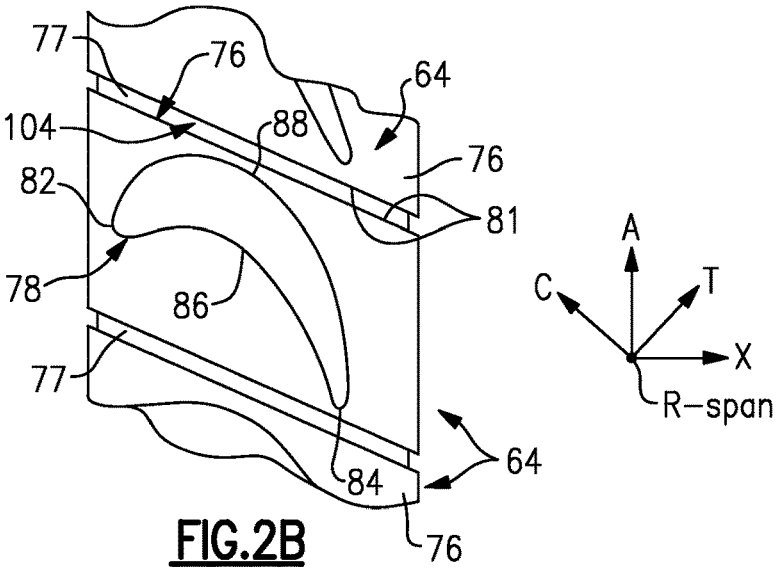
FIG. 2B is a plan view of the airfoil illustrating directional references.
Figure 3A:
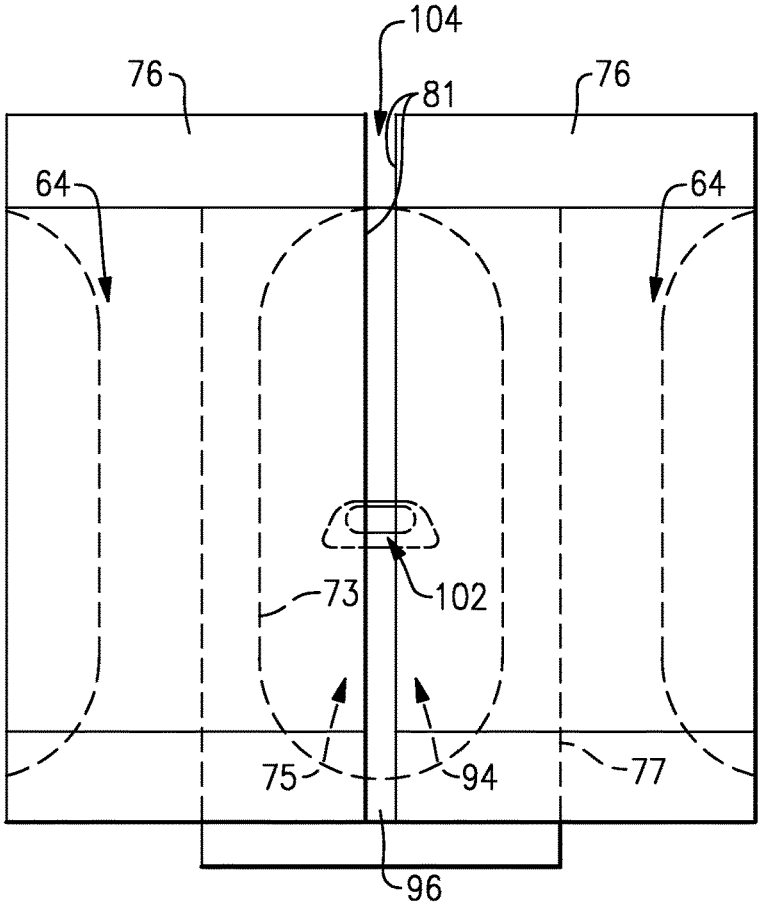
FIGS. 3A and 3B illustrate a seal arranged with respect to a platform.

Referring to FIGS. 2A and 2B, a root 74 of each turbine blade 64 is mounted to the rotor disk. The turbine blade 64 includes a platform 76, which provides the inner gas flow path, supported by the root 74. The platform 76 is supported relative to the root 74 by a neck 73. A pocket 75 is arranged beneath the platform 75, and adjacent pockets 75 form a cavity 94 (FIG. 3A).

With continuing reference to FIGS. 2A and 2B, an airfoil 78 extends in a radial direction R from the platform 76 to a tip 80. It should be understood that the turbine blades may be integrally formed with the rotor such that the roots are eliminated. In such a configuration, the platform is provided by the outer diameter of the rotor. The airfoil 78 provides leading and trailing edges 82, 84. The tip 80 is arranged adjacent to a blade outer air seal (not shown).

The airfoil 78 of FIG. 2B somewhat schematically illustrates exterior airfoil surface extending in a chord-wise direction C from a leading edge 82 to a trailing edge 84. The airfoil 78 is provided between pressure (typically concave) and suction (typically convex) wall 86, 88 in an airfoil thickness direction T, which is generally perpendicular to the chord-wise direction C. Multiple turbine blades 64 are arranged circumferentially in a circumferential direction A. The airfoil 78 extends from the platform 76 in the radial direction R, or spanwise, to the tip 80.

The airfoil 78 includes a cooling passage 90 provided between the pressure and suction walls 86, 88. The exterior airfoil surface may include multiple film cooling holes (not shown) in fluid communication with the cooling passage 90. Typically, the cooling fluid source that provides cooling fluid to the cooling passage 90 as provides some fluid into a pocket 75.

Adjoining platforms 76 provide a gap 104 circumferentially between lateral faces 81 of the adjoining platform 76. A seal 77 is arranged between the airfoils 78 and are in engagement with the platform 76. The seal 77 is positioned to obstruct the gap 104 in the radial direction to prevent gas path flow from entering the pockets 75.

Figure 3B:
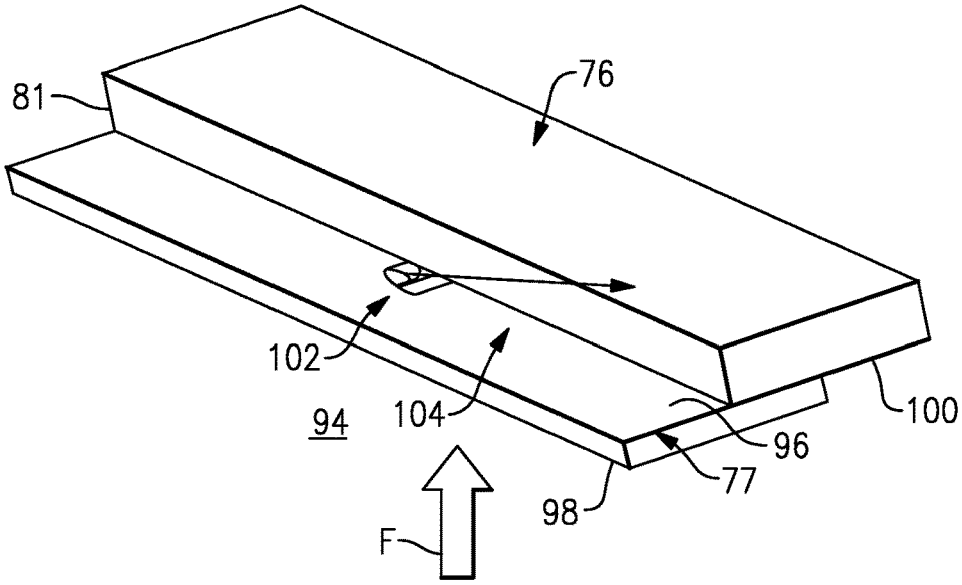
Figure 5B:
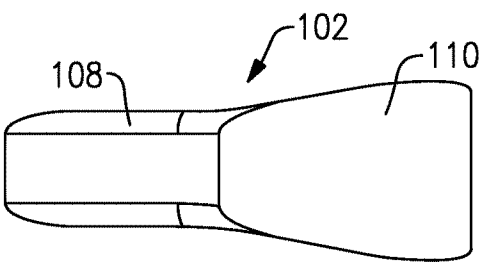
FIGS. 5A-5C illustrate an example cooling hole geometry for the seal.
Figure 5C:
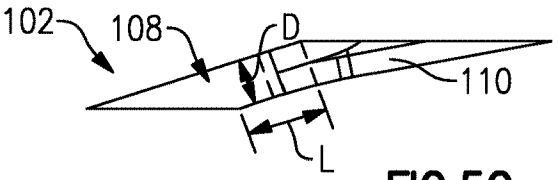

Referring to FIGS. 3A and 3B, adjacent gas turbine engine components are shown. The components may include the turbine blade 64 or a blade outer airseal 99 (FIG. 2A). The seal 77 has a gas path flow side 96 and another side 98 opposite the gas path flow side 96 and that faces the pocket 75. The gas path flow side 96 of the seal 77 seals against an underside 100 of the platform 76 in one example.

The pressure of fluid within the cavity 94 is greater than the pressure of fluid at the inner gas flow path. The seal 77 includes one or more cooling holes 102 (only one shown for clarity) that extends from the other side 98 to the gas path flow side 96 to provide fluid communication from the cavity 94 to the gap 104. In the example, the cooling hole 102 includes an increasing taper toward the gap 104 to diffuse the fluid flow through the cooling hole 102 as it exits the seal 77 into the gap 104. In this manner, the velocity of the cooling fluid through the hole 102 is slowed, such that the cooling fluid will linger within the gap 104 forming a boundary layer of cooling film.

Referring to FIGS. 4A-5C, the cooling hole 102 is at an angle 106 with respect to the gas path flow side 96, which helps maintain the fluid within the gap 104. The cooling hole 102, which is oriented generally in the lengthwise direction of the gap 104, includes a metering portion 108 extending from the other side 98 and fluidly connecting to a diffuser portion 110 that exits to the gas path flow side 96. The metering portion 108 has a smaller cross-sectional area than the diffuser portion 110. The diffuser portion 110 includes a width 112 in the generally in the circumferential direction A and a height 114 arranged generally in the axial direction X. The width 112 is greater than the height 114. As shown is FIGS. 3A and 3B, the width 112 of the cooling hole 102 is larger than the width of the gap 104, such that in the event of the lateral faces 81 separating during engine operation, sufficient cooling fluid will be provided to the gap 104.

The metering portion 108 has a diameter D (hydraulic diameter D if the cross-sectional area of the metering section 108 is not circular) and a length L that provides an L/D ratio of greater than 1, and in one example, greater than 3.

The cooling hole 102 can be any suitable shape and may be drilled or electro-discharge machined into the seal 77.

Figure 7:
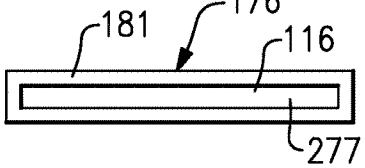
FIG. 7 illustrates a platform with a feather seal.
Figure 6:
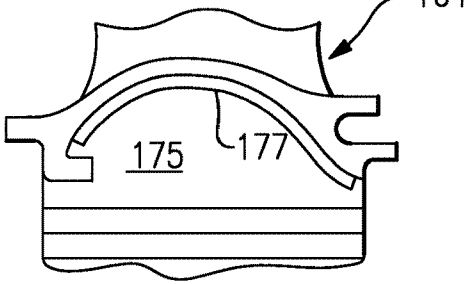
FIG. 6 illustrates a turbine blade platform with a damper seal.
Figure 5A:
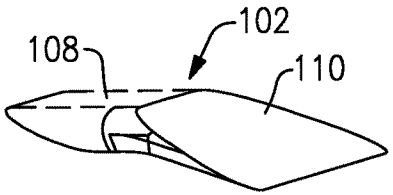
Figure 4A:
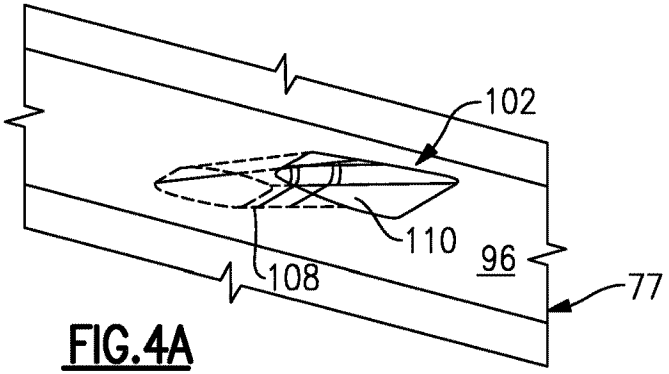
FIGS. 4A-4C illustrate the seal and a cooling hole that includes a taper.
Figure 4B:
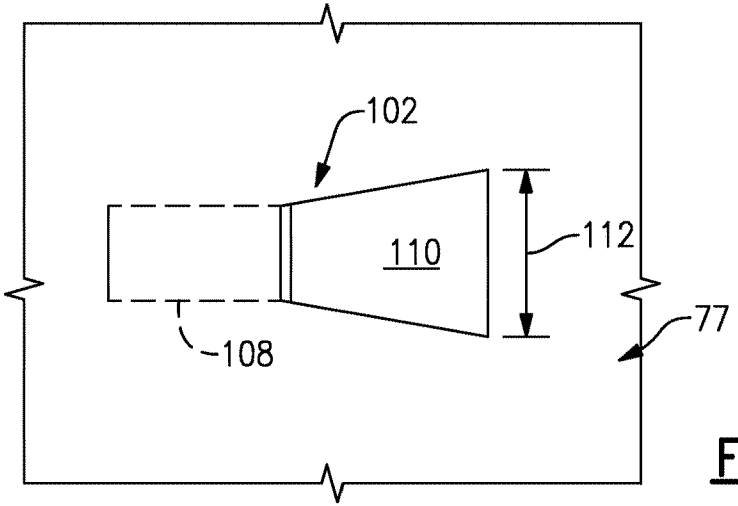
Figure 4C:
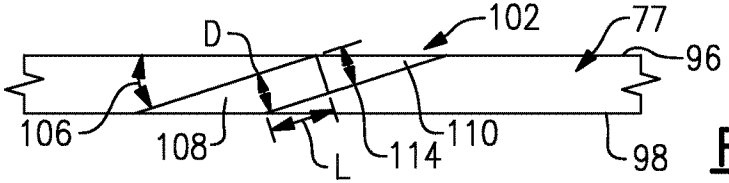

Referring to FIG. 6, the seal may be a damper seal 177 arranged within a pocket 175 of the blade 164. Additionally, the seal may be provided by a feather seal 277 arranged within a slot 116 in a lateral face 181 of the platform 176, as shown in FIG. 7.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although example embodiments have been disclosed, a worker of ordinary skill in this art would recognize that certain modifications would come within the scope of the claims. For that and other reasons, the following claims should be studied to determine their true scope and content.

What is claimed is:

1. A gas turbine engine component array comprising:

first and second components each having a platform, the platforms are arranged adjacent to one another and provide a gap circumferentially between axially lateral faces of the adjacent platforms; and a seal is arranged circumferentially between the first and second components and in engagement with the platforms to obstruct the gap, a cooling hole is provided in the seal and is in fluid communication with the gap, the cooling hole has an increasing taper toward the gap, wherein the lateral faces overlap the cooling hole in a circumferential direction, the cooling hole having a circumferential width that is larger than the width of the gap.

2. The gas turbine engine component array according to claim 1, wherein the seal includes a gas path flow side engaging the platforms, and another side arranged opposite the gas path flow side and facing a cavity provided between the first and second components, the cooling hole configured to fluidly connect the cavity to the gap.

3. The gas turbine engine component array according to claim 2, wherein the seal is a damper seal arranged in a pocket arranged beneath the platforms.

4. The gas turbine engine component array according to claim 2, wherein the seal extends circumferentially and axially between the lateral faces of the platforms to obstruct the gap.

5. The gas turbine engine component array according to claim 4, wherein a slot is provided in each of the lateral faces, and the seal is a feather seal arranged within the slots.

6. The gas turbine engine component array according to claim 1, wherein the cooling hole is arranged at an acute angle with respect to the gas path flow side, the cooling hole extending generally in a lengthwise direction of the gap.

7. The gas turbine engine component array according to claim 6, wherein the cooling hole includes a metering portion and a diffuser portion.

8. The gas turbine engine component array according to claim 7, wherein the metering portion has a length L and a diameter D, the metering portion having an L/D ratio of greater than 1.

9. The gas turbine engine component array according to claim 8, wherein the L/D ratio is greater than 3.

10. The gas turbine engine component array according to claim 7, wherein the diffuser portion includes a height, and the circumferential width is greater than the height, the circumferential width arranged in the circumferential direction.

11. The gas turbine engine component array according to claim 1, wherein the first and second components are blade outer airseals or turbine blades.

12. A method of cooling a gas turbine engine component array comprising the steps of:

providing cooling fluid to a cavity between adjacent components that provide a gap circumferentially between axially lateral faces of the adjacent components;

flowing cooling fluid from the cavity through a cooling hole in a seal provided between the adjacent components, wherein the seal is arranged circumferentially between the adjacent components, and the lateral faces overlap the cooling hole in a circumferential direction, the cooling hole having a circumferential width that is larger than the gap; and diffusing the cooling fluid through the cooling hole on a gas path flow side of the seal opposite the cavity to create a cooling film in the gap provided between adjacent platforms of the components.

13. The method according to claim 12, wherein the cooling hole is arranged at an acute angle with respect to the gas path flow side, the cooling hole extending generally in a lengthwise direction of the gap, the cooling hole includes a metering portion and a diffuser portion.

14. The method according to claim 13, wherein the metering portion has a length L and a diameter D and an L/D ratio of greater than 1, the diffuser portion includes a height, and the circumferential width is greater than the height, the circumferential width arranged in the circumferential direction.

15. The method according to claim 12, wherein the adjacent components are blade outer airseals or turbine blades.

* * * * *